US009388026B2

(12) United States Patent
Doig

(10) Patent No.: US 9,388,026 B2
(45) Date of Patent: Jul. 12, 2016

(54) WINCH AND METHOD OF USE THEREOF

(71) Applicant: Daniel Doig, Innisfil (CA)

(72) Inventor: Daniel Doig, Innisfil (CA)

( * ) Notice: Subject to any disclaimer, the term of this patent is extended or adjusted under 35 U.S.C. 154(b) by 338 days.

(21) Appl. No.: 14/152,995

(22) Filed: Jan. 10, 2014

(65) Prior Publication Data

US 2015/0197413 A1 Jul. 16, 2015

(51) Int. Cl.

| | |
|---|---|
| ***B66D 1/50*** | (2006.01) |
| ***B66D 1/04*** | (2006.01) |
| ***B63C 3/02*** | (2006.01) |
| ***B66D 5/34*** | (2006.01) |

(52) U.S. Cl.
CPC ... *B66D 1/04* (2013.01); *B63C 3/02* (2013.01); *B66D 5/34* (2013.01)

(58) Field of Classification Search
CPC ..... B66D 1/04; B66D 1/14; B66D 1/24; B66D 1/26; B66D 1/30; B66D 1/36; B66D 1/42; B66D 1/58; B66D 3/02; B66D 3/14; B66D 5/34; B66D 2700/0116; B66D 2700/05; B63C 3/02
See application file for complete search history.

(56) References Cited

U.S. PATENT DOCUMENTS

| | | | | |
|---|---|---|---|---|
| 4,986,141 | A * | 1/1991 | Meurer | B01D 21/04 185/37 |
| 5,678,805 | A * | 10/1997 | Moser | A63B 47/021 242/388.8 |
| 7,273,207 | B2 * | 9/2007 | Studer | B66D 1/26 254/278 |
| 7,594,640 | B1 * | 9/2009 | Mann | B66D 1/16 254/278 |
| 7,621,506 | B2 * | 11/2009 | Ebbenga | B60P 3/1075 254/278 |
| 2004/0104191 | A1 * | 6/2004 | Franzen | B66D 1/58 212/283 |
| 2010/0051767 | A1 * | 3/2010 | Erel | B66C 23/02 248/205.1 |
| 2014/0011627 | A1 * | 1/2014 | Lundrigan | B66D 1/04 475/326 |
| 2015/0008381 | A1 * | 1/2015 | Hausladen | B66D 1/30 254/288 |

* cited by examiner

*Primary Examiner* — Emmanuel M Marcelo
(74) *Attorney, Agent, or Firm* — Stuart L. Wilkinson

(57) ABSTRACT

A winch for moving a load along a track from a first position to a higher position has a drum around which a retrieve and a launch cable are wound in different directions. Rotation of the drum acts to reel in one of the cables while paying out the other. The retrieve cable extends directly between the drum and the near end of the load and the launch cable extends past the rear of the load though a sheave mounted on the track, and then back to far end of the load. A winding mechanism operates in retrieve mode to turn the drum to reel in the retrieve cable and pay out the launch cable. The winding mechanism is used in launch mode to turn the drum in the opposite direction to pay out the retrieve cable and reel in the launch cable. A brake mechanism is operable to halt runaway of the load along and down the track when the winch is being operated in launch mode.

17 Claims, 6 Drawing Sheets

WINCH AND METHOD OF USE THEREOF

FIELD OF THE INVENTION

This invention relates to winches and has particular, but not exclusive, application to launching and retrieving light water craft using a reciprocal carriage-on-track system.

DESCRIPTION OF RELATED ART

Winches are used for moving loads such as small powered or unpowered water craft along a mobile or fixed track system, the winch typically acting to drag the load up an inclined scope and to let the load down the inclined slope. Winches operate by the action of turning a drum to wind a tie, such as a cable or rope attached to the load, onto the drum. Reference in this specification to "cable" are intended to embrace rope, chain and other forms of long tie materials. A typical winch offers a mechanical advantage so that low torque turning of a pinion gear is converted to high torque turning of a drive gear attached to the winch drum. Winches may be hand operated or motor assisted.

It would be useful to have winches which can offer additional operational control compared with known winches, when operated in both launch and retrieve modes.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
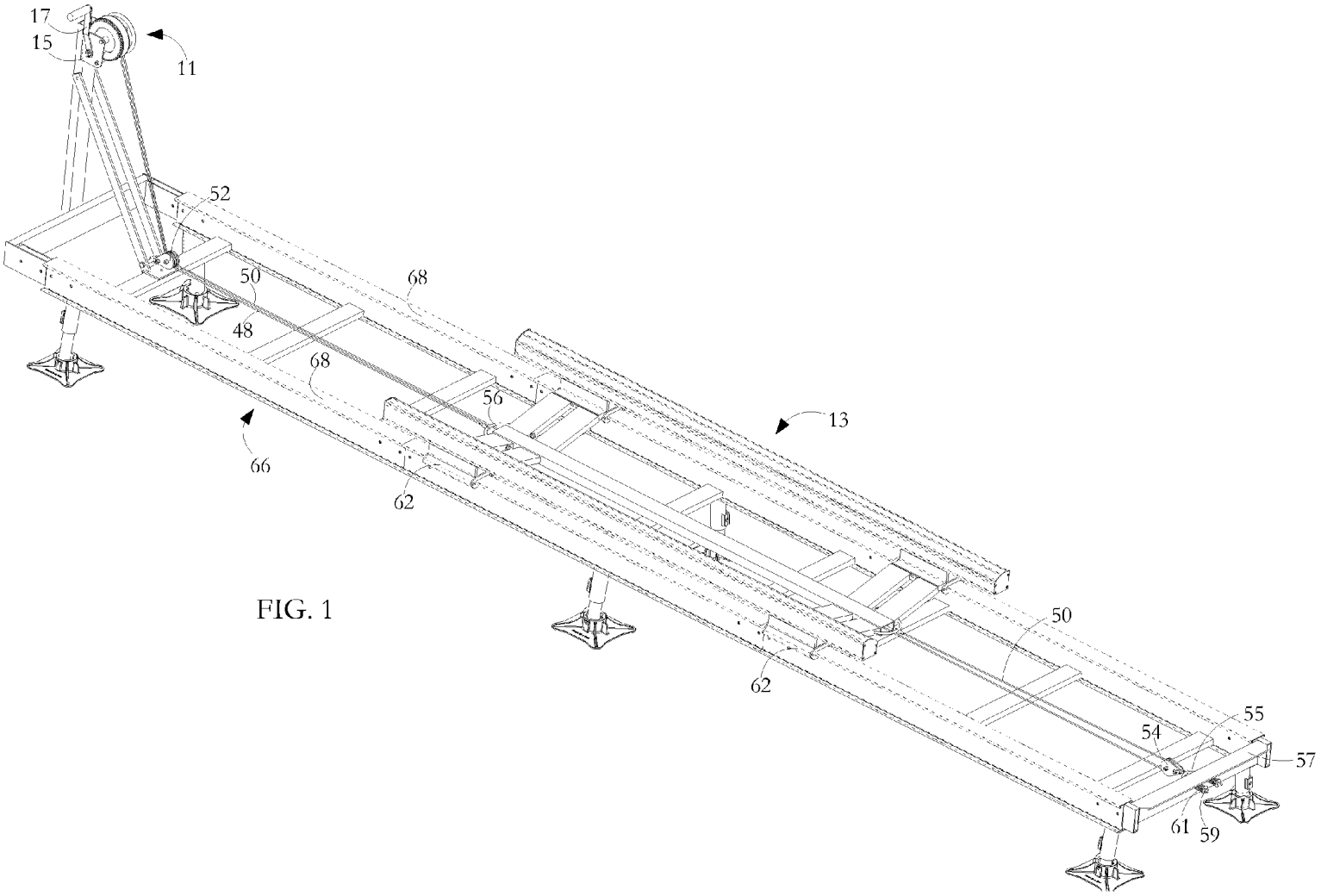
FIG. 1 is an isometric view of a carriage-on-track system using a winch according to an embodiment of the invention.

Referring in detail to FIG. 1, there is shown in isometric view a winch 11, a carriage 13 and a track system 66. The carriage slides over rails 68 of the track system by means of slider assemblies 62 mounted to the carriage 13, the assemblies 62 having sliders engaging the rails 68. The track is inclined downwardly towards the right so that the carriage 13 slides along and up the track towards the left and slides along and down the track towards the right. The carriage 13 forms a part of a load, with the carriage typically supporting a vehicle or other item (not shown), such as a personal water craft. In this example, sometimes referred to as a marine railway, the personal water craft is presumed to be near or in the water and is to be retrieved along and up the railed track system towards the winch, or the craft is positioned over land and is to be launched along and down the railed track away from the winch.

The carriage 13 is moved by means of a retrieve cable 48 and a launch cable 50 which turn on a drum of the winch 11. In this specification, the term "retrieve", in relation to movement of a load, means movement of the load towards the winch 11. The term "launch" means movement of the load away from the winch 11, regardless of whether a conventional launch is to be effected. The retrieve cable 48 extends down from the winch, passes round one of two routing sheaves 52, and has its end attached to the front of the carriage 13. The launch cable 50 extends down from the winch, passes round the other of the two routing sheaves 52, passes around a reversing sheave 54 mounted at the far end of the track, and has its end attached to the back of the carriage 13. The sheave 54 is mounted to a U bolt 55 that has bolt sections extending through a support bar 57. The bolt sections are retained in the support bar 57 by nut/ washer combinations 59 engaging with screw threaded ends of the bolt sections, the nut/washer combinations being spaced from the flange by compression springs 61.

In use, a load supported on the carriage 13 is pulled towards the winch 11 by means of the retrieve cable 48 or is pulled away from the winch by the launch cable 50 as will be described presently. The winch is operated by means of an operator turning handle 17. A brake mechanism in the winch is actuated in response to the operator releasing the handle 17. The brake mechanism also automatically deploys to prevent the load from running out of control along and down the track when the winch 11 is being operated in the launch mode as will be described presently.

Figure 2:
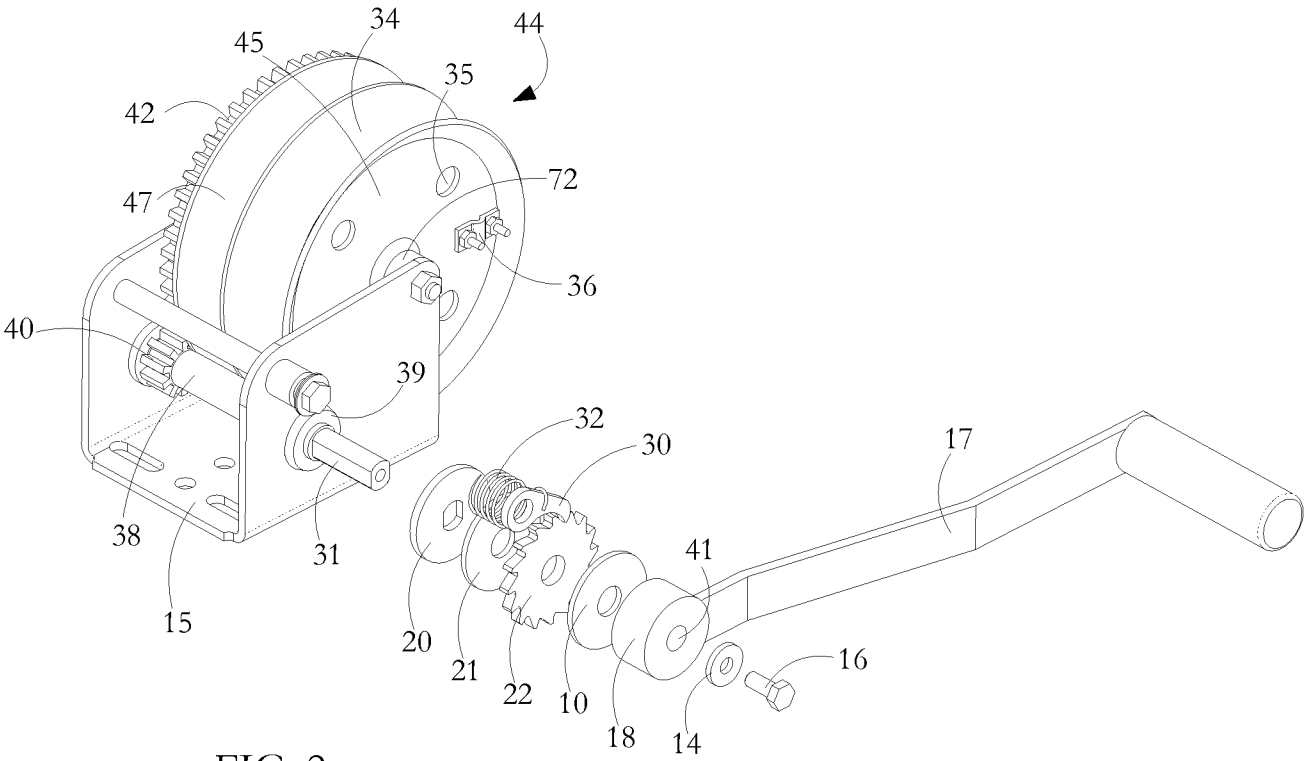
FIG. 2 is an isometric exploded view of a winch according to an embodiment of the invention.

Referring in detail to the exploded isometric view of FIG. 2, the illustrated winch 11 has a frame 15 to which are mounted a pinion shaft 38 and a main shaft 72. A drum 44 is made integral with the main shaft 72 by welding or attachment. The drum 44 has flanking flanges 45, 47, a central divider plate 34 and a drive gear 42. Although not shown in FIG. 2, the retrieve cable is wound in one direction around part 49 of the drum between the flange 45 and the divider plate 34, and the launch cable is wound in the opposite direction around part of the drum between the flange 47 and the divider plate 34. The retrieve cable projects through a hole 35 in the flange 45 and is anchored at a cable clamp arrangement 36. A similar arrangement is used to clamp the launch cable to the flange 47 (not shown).

Mounted on the pinion shaft 38 within the frame 15 is a pinion gear 40 which meshes with the drive gear 42. Turning the pinion shaft 38 causes the drive gear 42 and drum 44 to be turned to draw the retrieve and launch cables onto or off the drum depending on the direction in which the drum is turned.

Mounted on the pinion shaft 38 outside the frame 15 are several elements which together constitute a winding mechanism and a brake mechanism. These elements include, in order of assembly from an outer end region of the pinion shaft 38, a crank handle 17 and hub 18, an outer drive disc 14, an outer friction disc 10, a ratchet wheel 22, an inner friction disc 21, and an inner drive disc 20. The ratchet wheel 22 engages with a pawl 30 mounted on the frame 15, with the pawl being spring biased by spring 32 into engagement with the teeth of the ratchet wheel 22.

The ratchet wheel 22 is free to rotate in a clockwise direction as shown in FIG. 2 by the pawl 30 riding up and over the ratchet wheel teeth but may be prevented from rotating in an anticlockwise direction by locking engagement of the pawl 30 between adjacent teeth of the ratchet wheel 22. A part of the pinion shaft 38 projecting from the frame 15 has opposed flats 31 and the drive disc 20 has an aperture matched to the cross-sectional shape of the pinion shaft 38 at the flats 31 so that the drive disc 20 and the pinion shaft 38 are constrained to turn together. The pinion shaft 38 has a shoulder 39 forming an abutment against which the drive disc 20 bears when the winch 11 is in a braking mode as will be described presently.

The hub 18 has a central ⅝ inch internal threaded bore and a projecting part of the pinion shaft 38 outside the frame 15 has a matching exterior thread, with the hub in screw engagement with the shaft projecting part. The hub 18 is free to rotate on the pinion shaft 38 between limiting positions which determine whether the winch 11 operates in a launch or retrieve mode.

Projecting into the end of the pinion shaft is a 5/16 diameter threaded bore 41. The outer drive disc 14 is retained next to the hub by a 5/16 diameter hex bolt 16 engaged in the bore 41. The threads of the bolt 16 and bore 41 are left hand threads so that anticlockwise turning of the handle 17 in launch mode will tend to tighten the bolt 16 in bore 41 rather than release it. The threads of the projecting portion of shaft 38 and the interior of hub 18 are conventional right hand threads. The crank handle 17 forms an integral structure with the hub 18 by being welded or mechanically fixed to it. The friction discs 10, 21, the drive disc 14, and the ratchet wheel 22 are not attached to the pinion shaft 38. They are mounted so as to permit rotation relative to the shaft 38 when the winch is operated in a launch mode. Such relative rotation is however prevented when the winch 11 is operated in retrieve mode or in brake mode. A brake mechanism is engaged if turning of the handle 17 in either direction is halted by the operator and the handle is released. The brake is also engaged automatically if there is any sudden slippage of the load down the track when operating in launch mode, as will be described presently.

Figure 3:
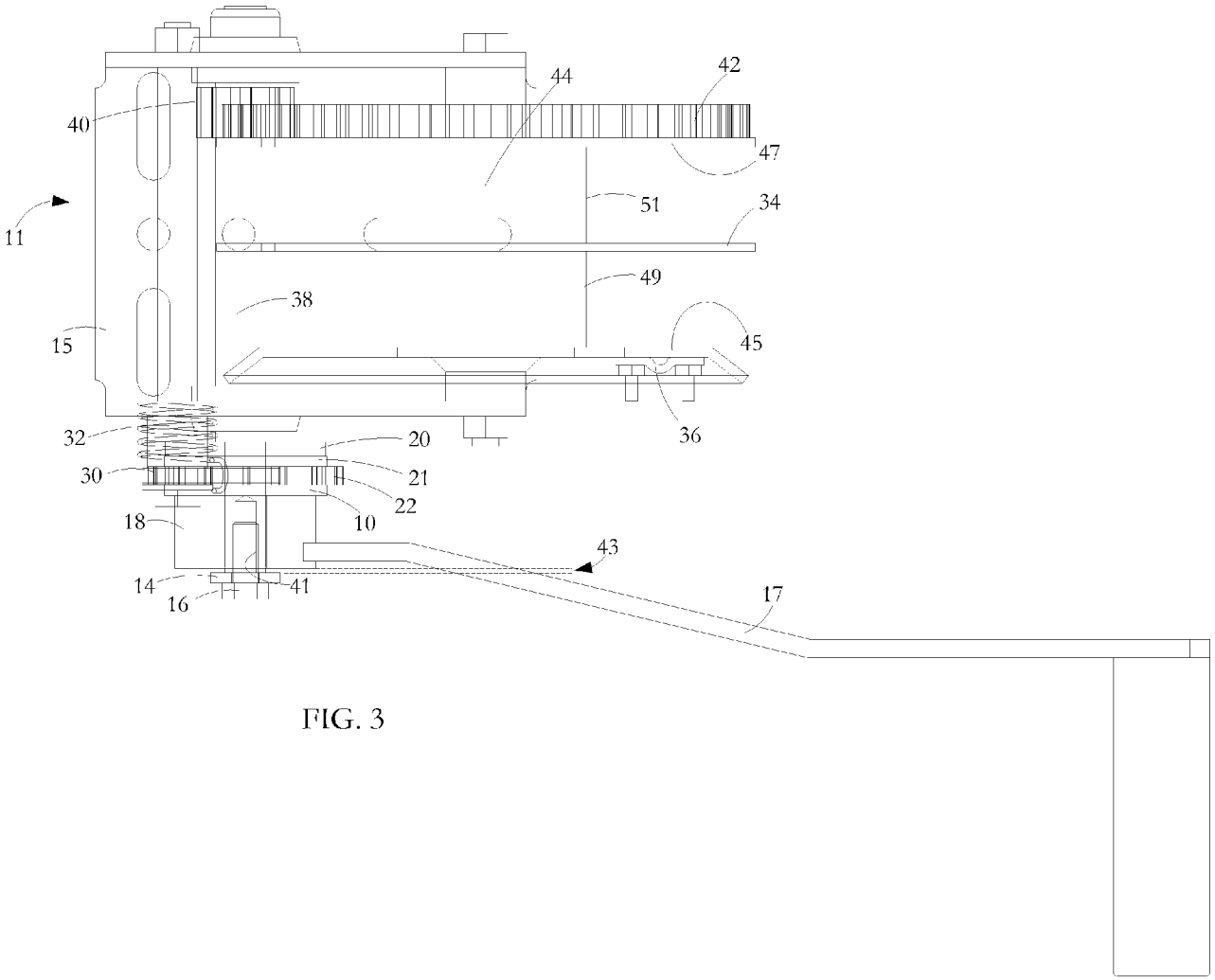
FIG. 3 is a top view of the winch of FIG. 2 shown in a retrieve mode.
Figure 4:
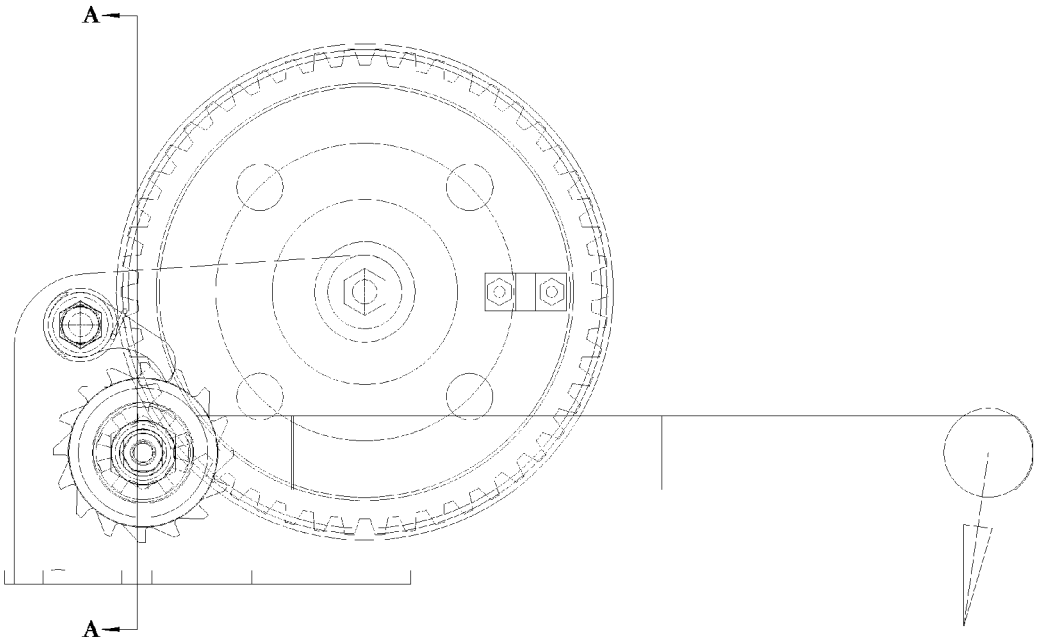
FIG. 4 is a side view of the winch of FIG. 3.
Figure 5:
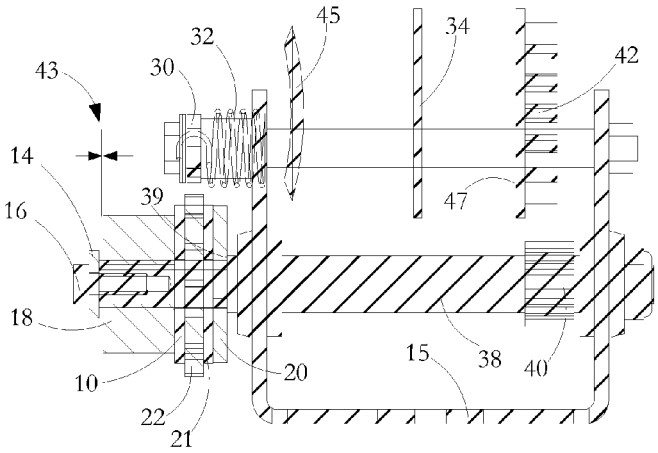
FIG. 5 is a sectional view on the line A-A of FIG. 4.
Figure 6:
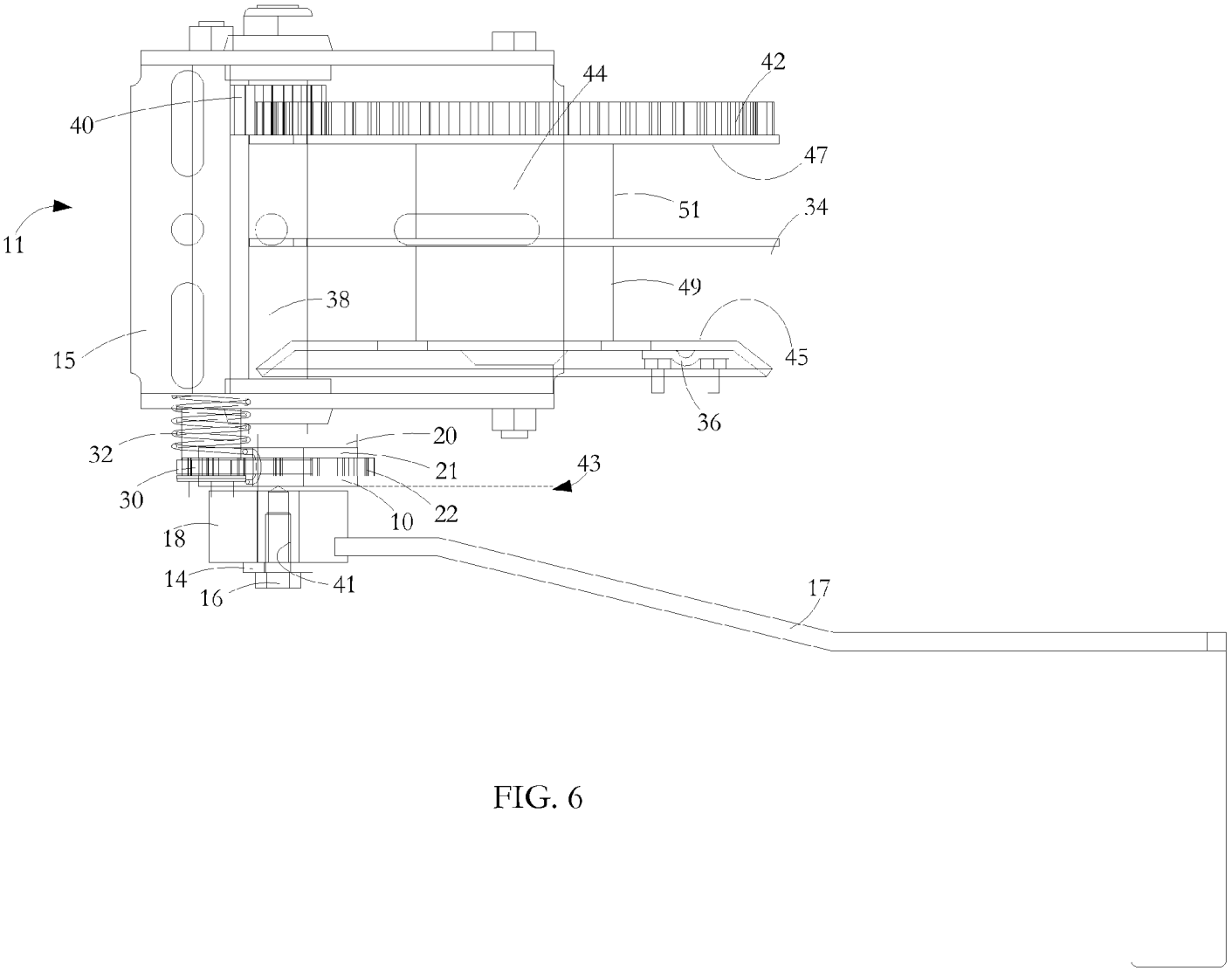
FIG. 6 is a top view of the winch of FIG. 2 shown in a retrieve mode.
Figure 7:
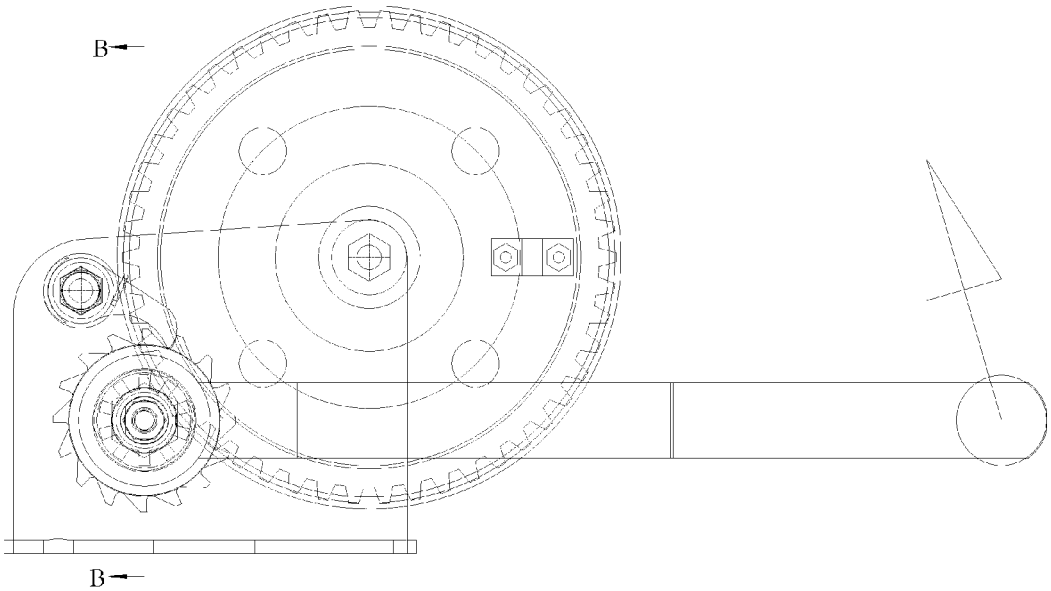
FIG. 7 is a side view of the winch of FIG. 6.

Operation of the winch 11 in the context of retrieving and launching the load is now described with reference to FIGS. 3 to 8, where FIGS. 3, 4 and 5 show the winch being used in retrieve mode, and FIGS. 5, 6 and 7 show the winch being used in launch mode.

In retrieve mode, the handle 17 is turned clockwise around the axis of hub 18. In this mode, the threaded interior of the handle hub 18 is in screw engagement with the external threaded end portion of the pinion shaft 38, and the retrieve cable 48 is in tension owing to the weight of the load "hanging" down the inclined slope. Initially, the drum 44 and the associated pinion shaft 38 are restrained from turning by the load imposed on the retrieve cable 48. Consequently, as the handle 17 is turned in the clockwise direction, the handle hub 18 screws along the pinion shaft 38 towards the drum 44 until it squeezes the two friction discs 10, 20, the ratchet wheel 22 and inner drive disc 20 together up against the shoulder 39 of the shaft 38. Once these elements are hard up against one another and the shoulder 39, subsequent clockwise turning of the handle 17 causes torque to be applied through the pinion shaft 38 and the winch drum 44, and the drum rotates in a counterclockwise direction to reel in the retrieve cable 48 onto part 49 of the drum while paying out the launch cable 50 from part 51 of the drum. Because the handle hub 18, the friction discs 10, 21, the ratchet wheel 22, the drive disc 20 and the pinion shaft 38 are clamped together, they function essentially as a single assembly locked to the pinion shaft. As the pinion shaft is driven in the retrieve direction, the spring biased pawl 30 moves over the ratchet wheel 22 allowing the cables 48, 50 and the associated load to be moved in the retrieve direction but with the pawl 30 preventing movement of the cables and load in the launch direction: i.e. preventing any unintended "back driving" of the system while in retrieve mode. In the retrieve mode, the winch is driven solely by the clamping created by the handle hub 18 squeezing the friction discs 10, 21 and intermediate ratchet wheel 22 against the drive disc 20 and the shoulder 39 of the pinion shaft 38. In this mode, the tension in the retrieve cable 48 is determined by the weight of the load acting down the inclined slope. Tension in the launch cable 50 is lower and is determined by the action of the compression springs 61.

In contrast, in the launch mode, the crank handle 17 is turned counterclockwise. Initially, the retrieve cable 48 may be under tension arising from "hanging" load and with the pawl 30 engaged by ratchet wheel 22. Alternatively, the load may be in a stalled position resting on the track and retained there under static frictional engagement between the load and the track.

The latter situation is often encountered by those using conventional winches in launch mode. In a conventional winch, with a retrieve cable and brake, but no launch cable, the load may simply sit when the winch handle is turned in reverse to release the brake. The cable slackens but the load does not move down the inclined slope to allow launch to occur. With brake release alone being insufficient to allow the load to start to move under its own weight, the winch operator may have to let go of the winch handle, go to the load and give it a push start along and down the track. If the launch is sufficient to release the load, it slides a small distance along the track under its own weight until the winch brake automatically engages. At this time, because the retrieve cable is now under load tension arising from the action of the weight component of the load, subsequent reverse turning of the winch handle to release the brake enables the load to move down the track under its own weight as the cable is paid out until the desired load position is reached or until a subsequent stall occurs. Once the load is at its desired position, the operator can cease anticlockwise turning of the winch handle.

Figure 8:
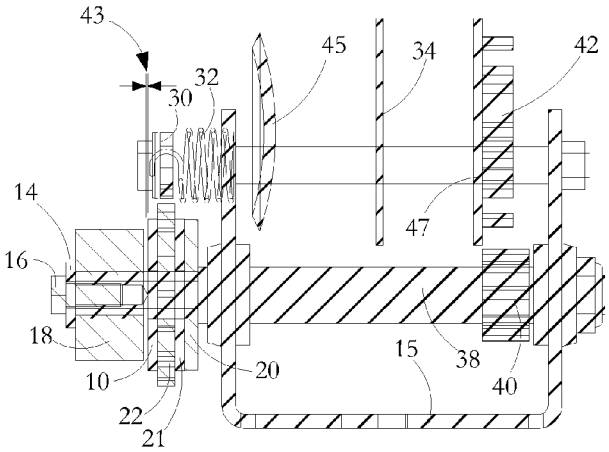
FIG. 8 is a sectional view on the line B-B of FIG. 7.

In the embodiment of the invention illustrated in FIGS. 6 to 8 in launch mode, because the internal thread on the handle hub 18 is in engagement with the external thread on the end portion of the pinion shaft 38, and the winch drum 44 including the pinion shaft 38 is restrained from turning by the "hanging" load, initial anticlockwise turning of the pinion shaft 38 causes the hub 18 to unscrew away from the drum 44 until the outside of the hub 18 runs up tight against the drive disc 14 under the head of bolt 16. Because further axial movement of the hub 18 along the pinion shaft 38 is prevented owing to the hub 18 abutting the drive disc 14, further turning of the handle 18 causes torque to be transmitted to the pinion shaft 38.

As described previously with reference to the conventional winch, at this point, the retrieve cable may be under tension arising from action of the hanging load and with the pawl 30 engaged by ratchet wheel 22. Alternatively, the load may be in a stalled position on the track owing to static friction.

If there is no stall—for example, the slope is steep and the load "hangs" at the end of the retrieve cable, further anticlockwise turning of the handle 18 causes the retrieve cable 48 to be paid out from part 49 of the drum 44 (FIG. 3) and the load moves down the inclined slope. Such anticlockwise turning simultaneously winds the launch cable 50 onto part 51 of the drum. At this time the pawl and ratchet mechanism is ineffective because clamping pressure to lock the ratchet assembly against the shoulder 39 of the pinion shaft has been released. However, if the operator lets go of the handle 18, the hanging load acting through the retrieve cable 48 causes the pinion shaft 38 and the hub 18 to screw together, clamp the ratchet assembly to the shaft, and so engage the brake.

If there is a stall—for example, the inclined slope is too gentle and there is static resistance to the load moving along and down the track, tension applied to the launch cable 50 by anticlockwise turning of the handle 18 increases, tension in the retrieve cable being then determined by the action of the compression springs 61. As long as the static resistance is maintained, the load is dragged along and down the track by the launch cable 50. However, if the load starts to run down the track under its own weight, this results in a sudden increase in tension in the retrieve cable 48. This is transmitted through the drum 44 to the pinion shaft 38 to cause the shaft to turn relative the hub 18. This, in turn, causes the hub to move along the pinion shaft, to close the gap, and then to squeeze the hub, friction discs, ratchet wheel and drive disc 20 together against the shaft shoulder 39. At this point, the ratchet wheel 22 effectively becomes locked to the pinion shaft 38 and the engagement between the pawl and ratchet wheel halts any further uncontrolled rotation of the shaft 38. This acts to brake further rotation of the drum 44 and runaway movement of the load.

The width of the gap 43 as illustrated in FIGS. 3 and 6 determines the permitted amount of pinion shaft rotation between limiting positions corresponding to the winch 11 being in the launch or the retrieve mode The elements of the winch are dimensioned and configured so that in one embodiment, the gap 43 is of the order of 1/16 inch, the movement of handle 17 in changing from operation in retrieve mode to operation in launch mode is of the order of a ¾ turn, and the corresponding cable movement is about 1 inch.

Variations and modifications will be apparent to those skilled in the art and, in this respect, the embodiments of the invention described and illustrated are not intended to be limiting. The principles of the invention as defined in the claims appended hereto contemplate many alternatives having advantages and properties evident in the exemplary embodiments.

Thus, for example, the inner abutment against which the ratchet assembly is clamped when the winch is operated in the retrieve or retrieve mode can be configured differently from the shaft shoulder formation 39. For example, the inner abutment can be configured as a region of the shaft 38 having larger diameter than the main part of the shaft. Similarly the outer abutment against which the hub is driven in the launch mode can be configured differently from the drive disc and bolt arrangement illustrated. For example, the outer abutment can similarly be configured as a section of the pinion shaft having larger diameter than an immediately adjacent part of the shaft.

In addition, the illustrated arrangement of a pinion gear 40 and a drive gear 42 offer a mechanical advantage. The winching and braking functionalities implemented on the pinion shaft can alternatively be effected directly on the drum shaft, with the pinion arrangement being dispensed with. In this case, a crank handle (or powered equivalent) is used to turn the drum directly instead of through a geared arrangement. In addition, as an alternative to a single pinion gear and drive gear, other gearing arrangements are contemplated.

Although the track in the illustrated embodiment is a railed system along which the carriage slides, the winch can be used with other forms of track. For example, a load such as a personal water craft can be winched directly on to a track frame having bunks mounted thereon along which the craft slides. In another alternative, a series of roller pairs is mounted on the track with a roller of each pair on respective sides of the track. The rollers are mounted so that peripheral bearing surfaces of the rollers are orientated to sit relatively flat against the bottom surface of a craft being winched onto or off the track. Other forms of track or of track/carriage combinations can be used with winches embodying the invention. For example, such winches can be used with fixed systems or with mobile systems; i.e. trailers.

What is claimed is:

1. A winch for moving a load, comprising a frame and a drum mounted on the frame for rotation thereof, a retrieve cable for fixing to the load and wound in a first direction around a first drum part, a launch cable for fixing to the load and wound in the opposite direction around a second drum part, a winding mechanism for turning the drum in a retrieve rotation to wind the retrieve cable onto the drum and to pay out the launch cable, and for turning the drum in a launch rotation to wind the launch cable onto the drum and to pay out the retrieve cable, a pinion shaft having a pinion gear engaging a drive gear integral with the drum, and a brake mechanism operable to halt launch rotation of the drum in response to a sudden increase in tension in the retrieve cable caused by the weight of the load acting on the retrieve cable, further comprising, the brake mechanism including a pawl mounted on the frame, and a ratchet assembly mounted on the pinion shaft, the ratchet assembly having a released configuration in which a ratchet wheel forming a part thereof is rotatable on the pinion shaft, and a locked configuration in which the ratchet wheel is locked to the pinion shaft.

2. A winch as claimed in claim 1, the winding mechanism including a drive hub in screw engagement with a portion of the pinion shaft whereby rotation of the hub relative to the pinion shaft effects relative axial movement of the hub on the shaft between an outer limiting position in which the ratchet assembly is in the released configuration and an inner limiting position in which the ratchet assembly is in the locked configuration.

3. A winch as claimed in claim 2, further comprising an inner abutment having a fixed axial position relative to the pinion shaft, the ratchet assembly fixed tight against the inner abutment in the inner limiting position.

4. A winch as claimed in claim 3, wherein an initial rotation of the hub in a first direction causes movement of the hub axially along the pinion shaft to the inner limiting position, and subsequent rotation of the hub in the first direction turns the pinion shaft in said first direction to effect retrieve rotation of the drum.

5. A winch as claimed in claim 4, further comprising an outer abutment having a fixed axial position relative to the pinion shaft, the hub fixed tight against the outer abutment in the outer limiting position.

6. A winch as claimed in claim 5, wherein an initial rotation of the hub in a second direction opposite to the first direction causes movement of the hub axially along the pinion shaft to the outer limiting position, and subsequent rotation of the hub in the second direction turns the pinion shaft in said first direction to effect launch rotation of the drum.

7. A winch as claimed in claim 5, the outer abutment provided by a bearing disc fixed to an outer end of the pinion shaft by a bolt engaging in a threaded bore extending axially into the end of the pinion shaft.

8. A winch as claimed in claim 7, the thread direction of the bolt and the threaded bore such that rotation of the hub in said second direction tends to tighten the bolt in the bore.

9. A winch as claimed in claim 7, the screw engagement between the bolt and the bore being of opposite thread direction to the screw engagement between the hub and the shaft.

10. A winch as claimed in claim 3, the inner abutment provided by a shoulder formed on the pinion shaft, and a bearing disc mounted on the shaft and positioned against the shoulder, the bearing disc constrained to rotate with the pinion shaft.

11. A winch as claimed in claim 2, the screw engagement between the hub and the pinion shaft provided by an interior thread in the hub and an exterior thread on the pinion shaft.

12. A winch as claimed in claim 2, further comprising a cranked turning handle integral with the hub.

13. A winch as claimed in claim 1, the ratchet assembly further comprising a pair of friction discs mounted on the pinion shaft at opposite sides of the ratchet wheel.

14. A winch as claimed in claim 1, the drum having a flange dividing the drum into the first and second drum parts.

15. A winch as claimed in claim 1, the drum having flanking flanges between which the cables are wound onto the drum, the flanking flanges each having an aperture and clamping arrangement for clamping ends of the respective cables.

16. A winch installation including a winch as claimed in claim 1, the load mounted for winch controlled reciprocal motion up and along an inclined track forming part of a base, the winch mounted on the base, the retrieve cable extending from the drum to a front end of the load, the launch cable extending from the drum, around a sheave attached to the base and back to a rear end of the load.

17. A winch installation as claimed in claim 16, further comprising a spring mechanism between the base and a mounting for the sheave for maintaining the launch cable taut.

* * * * *